US007989412B2

(12) United States Patent
Mayer et al.

(10) Patent No.: US 7,989,412 B2
(45) Date of Patent: Aug. 2, 2011

(54) SOLID TEXTILE CARE COMPOSITION BASED ON SOAP

(75) Inventors: Konstanze Mayer, Duesseldorf (DE); Karl-Heinz Scheffler, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/246,114

(22) Filed: Oct. 6, 2008

(65) Prior Publication Data

US 2009/0099055 A1 Apr. 16, 2009

Related U.S. Application Data

(63) Continuation of application No. PCT/EP2007/052126, filed on Mar. 7, 2007.

(30) Foreign Application Priority Data

Apr. 6, 2006 (DE) ..... 10 2006 016 586

(51) Int. Cl.
*C11D 17/00* (2006.01)

(52) U.S. Cl. ..... 510/445; 510/447; 510/450; 8/115.51

(58) Field of Classification Search ..... None
See application file for complete search history.

(56) References Cited

U.S. PATENT DOCUMENTS

| | | | |
|---|---|---|---|
| 3,226,329 | A | 12/1965 | Kilmer MacMillan |
| 3,915,882 | A | 10/1975 | Nirschl et al. |
| 5,206,019 | A | 4/1993 | Nichols |
| 6,403,543 | B1 | 6/2002 | George |
| 2006/0234902 | A1 | 10/2006 | Zhu et al. |
| 2007/0203044 | A1 | 8/2007 | Zhu et al. |

FOREIGN PATENT DOCUMENTS

| | | | |
|---|---|---|---|
| DE | 196 20 792 | A1 | 11/1997 |
| EP | 1 715 030 | A1 | 10/2006 |
| FR | 2 725 456 | | 4/1996 |

OTHER PUBLICATIONS

International Search Report of PCT/EP2007/052126, dated Jun. 29, 2007.

*Primary Examiner* — Necholus Ogden, Jr.
(74) *Attorney, Agent, or Firm* — RatnerPrestia

(57) ABSTRACT

A solid textile-care composition having a matrix of soap and, distributed therein, a textile-care compound and a perfume. Also, textile-softening laundry detergents or cleaning agents containing the textile-care composition.

17 Claims, No Drawings

SOLID TEXTILE CARE COMPOSITION BASED ON SOAP

CROSS REFERENCE TO RELATED APPLICATIONS

This application is a continuation under 35 U.S.C. §§120 and 365(c) of International Application PCT/EP2007/052126, filed on Mar. 7, 2007. This application also claims priority under 35 U.S.C. §119 of DE 10 2006 016 586.1, filed Apr. 6, 2006. The disclosures of PCT/EP2007/052126 and DE 10 2006 016 586.1 are hereby incorporated by reference in their entirety.

BACKGROUND OF THE INVENTION

The invention relates to a solid textile-care composition and to its use and manufacture. The invention further relates to a laundry detergent or cleaning agent that contains the solid textile-care composition.

Repeated washing often causes textiles to become hard and lose their softness. In order to restore softness and flexibility to textiles, in order to impart a pleasant scent to them, and/or in order to improve their anti-static properties, the textiles are treated with a conditioner in a subsequent rinsing process after the actual washing and cleaning process.

Most conditioners on the market are aqueous formulations that contain as the principal active constituent a cationic textile-softening compound that comprises one or more long-chain alkyl groups in one molecule. Widely used cationic textile-softening compounds encompass, for example, methyl-N-(2-hydroxyethyl)-N,N-di(tallowacyloxyethyl)ammonium compounds or N,N-dimethyl-N,N-di(tallowacyloxyethyl)ammonium compounds.

Because of the cationic textile-softening compounds, these conventional conditioner formulations cannot be used simultaneously with the laundry detergent or cleaning agent in the actual washing or cleaning process, since the cationic textile-softening compounds interact undesirably with the anionic surfactants of the laundry detergent or cleaning agent. An additional rinsing operation is therefore necessary, but this is time- and energy-intensive.

A further disadvantage is that conventional conditioners do not prevent the deposition of lime residues onto the laundry during the rinsing operation. In addition, the conventional conditioners often leave behind an unattractive deposit in the bleach dispenser of the washing machine.

Problems can also occur with other textile-care compounds, requiring e.g. separate dispensing and/or a separate rinse cycle.

DESCRIPTION OF THE INVENTION

It is therefore an object of the present invention to make available a textile-care composition that can be used in the main washing cycle together with laundry detergents or cleaning agents.

This object is achieved by a solid textile-care composition encompassing a matrix of soap as well as, distributed therein, a textile-care compound and a perfume.

A textile-care composition of this kind can be used in the main washing cycle of an automatic washing or cleaning method. The textile-care composition can, for example, be introduced together with the laundry detergent or cleaning agent into the drum or into the bleach dispenser of a washing machine. This has the advantage that an additional rinse cycle is not necessary, and that unattractive deposits do not occur in the bleach dispenser. This solid composition can moreover be handled better and more easily than liquid compositions, since droplets do not remain behind on the rim of the bottle, which droplets, when the bottle is then stored, can result in rings on the substrate or in unattractive deposits in the region of the closure. The same applies to the case in which some of the composition is inadvertently spilled during dispensing. Because soaps also have a water-softening effect, lime deposits on the laundry are additionally prevented.

It is furthermore advantageous that the textile-care compound and the perfume are already transported directly to the laundry at the beginning of the washing process, and can thus achieve their full potential.

It is preferred that the textile-care compound be selected from textile-softening compounds, bleaching agents, bleach activators, enzymes, silicone oils, anti-redeposition agents, optical brighteners, graying inhibitors, shrinkage preventers, wrinkle protection agents, color transfer inhibitors, antimicrobial active substances, germicides, fungicides, antioxidants, antistatic agents, ironing adjuvants, proofing and impregnation agents, swelling and anti-slip agents, UV absorbers, and mixtures thereof.

It is particularly preferred that the textile-care compound is a textile-softening compound. It is very particularly preferred in this context that the textile-softening compound is selected from polysiloxanes, textile-softening clays, cationic polymers, and mixtures thereof.

The use of polysiloxanes and/or cationic polymers as a textile-softening compound in the textile-care composition is advantageous because they not only exhibit a softening effect, but also intensify the perfume impression on the laundry. The use of softening clays as a textile-softening compound in the textile-care composition is advantageous because they additionally have a water-softening effect, so that lime deposits on the laundry are prevented. In order to achieve optimum performance, it may be preferred that the textile-care composition contain a combination of at least two textile-care, in particular at least two textile-softening, compounds.

In a preferred embodiment, the soap contains sodium salts of fatty acids selected from the group comprising palm oil fatty acids, palm kernel oil fatty acids, coconut fatty acids, peanut fatty acids, tallow fatty acids, stearic acid, oleic acid, soy fatty acids, olive oil fatty acids, and mixtures.

These soaps are solid, and can thus function particularly well as a matrix for the solid textile-care compositions.

In a further, preferred embodiment, the matrix of soap contains further additives selected from the group comprising propylene glycol, dipropylene glycol, ethylene glycol, diethylene glycol, 1,3-butylene glycol, 2,3-butylene glycol, sorbitol, glycerol, mannitol, glucose, sucrose, galactose, fructose, lactose, dextrose, and mixtures thereof.

Textile-care compositions having a soap matrix of this kind dissolve particularly well and quickly. As a result of the good dissolution behavior, the textile-care compound and the perfume are distributed quickly and uniformly in the washing bath, and can thus achieve their optimum effect. In addition, the additives enhance the transparency of the textile-care composition.

It is preferred that the quantity of perfume be 0.1 to 20 wt %, preferably 1 to 10 wt %, and particularly preferably 2 to 7 wt %.

With conventional liquid conditioner compositions having quaternary ammonium compounds as a textile-care compound, a problem occurs at higher perfume concentrations (>0.4 wt % perfume for regular conditioner compositions, and ≧1 wt % for concentrated conditioner compositions) with the stability of the composition. With the textile-care compositions according to the present invention, large quantities of perfume (≧1 wt %) can be incorporated without difficulty.

It is preferred that the matrix of the solid textile-care composition contain 50 to 98 wt %, by preference 90 to 97 wt %, soap.

In a preferred embodiment, the solid textile-care composition is present in particulate form. It is particularly preferred in this context that the solid textile-care composition exhibit particle sizes in the range from 0.6 to 30 mm, in particular 0.8 to 7 mm, and particularly preferably 1 to 3 mm. Textile-care compositions having these particle sizes can be dispensed particularly well and accurately.

The invention also relates to the use of a solid textile-care composition according to the present invention for the conditioning of textile fabrics.

The invention furthermore relates to a method for manufacturing a solid textile-care composition according to the present invention, encompassing a matrix of soap as well as, distributed therein, a textile-care compound and a perfume, in which method the ingredients are mixed and the mixture obtained is then extruded through a rhomboidal orifice plate.

The invention further relates to a laundry detergent or cleaning agent encompassing a solid textile-care composition according to the present invention.

The introduction of the textile-care composition according to the present invention into a laundry detergent or cleaning makes available to the consumer a textile-care laundry detergent or cleaning agent ("two in one" laundry detergent or cleaning agent), and he or she does not need to dispense two agents (a laundry detergent or cleaning agent and a textile-care composition). Upon introduction of a textile-softening composition into a laundry detergent or cleaning agent, the consumer is thus provided with a textile-softening laundry detergent or cleaning agent ("two-in-one" laundry detergent or cleaning agent), and he or she does not need to dispense two agents (laundry detergent or cleaning agent and conditioner), and does not require a separate rinse cycle.

In addition, it is not necessary to perfume the laundry detergent or cleaning agent and the textile-care composition, but only the textile-care composition. This not only yields lower costs, but is also advantageous for consumers with sensitive skin and/or allergies.

The invention is explained below, with reference inter alia to examples.

The textile-care composition contains a matrix of soap as well as, distributed therein, a textile-care compound and a perfume.

The matrix of soap contains, as a principal constituent, the sodium salts of fatty acids selected from the group comprising palm oil fatty acids, palm kernel oil fatty acids, coconut fatty acids, peanut fatty acids, tallow fatty acids, stearic acid, oleic acid, soy fatty acids, olive oil fatty acids, and mixtures thereof. The matrix of the solid textile-care composition contains by preference 50 to 98 wt %, particularly preferably 90 to 97 wt % soap.

Additionally, the matrix can also contain potassium and/or ammonium salts of fatty acids. The proportion of these fatty acid soaps should, however, be as low as possible.

The matrix of soap preferably contains further additives that are selected from the group comprising propylene glycol, dipropylene glycol, ethylene glycol, diethylene glycol, 1,3-butylene glycol, 2,3-butylene glycol, sorbitol, glycerol, mannitol, glucose, sucrose, galactose, fructose, lactose, dextrose, and mixtures thereof.

The transparency of the textile-care composition is increased by these additives. The quantity of these additives is by preference between 0.1 and 25 wt %, and particularly preferably between 5 and 15 wt %.

A "textile-care compound" is understood in this connection as any compound that imparts to textile fabrics treated therewith an advantageous effect such as, for example, a textile-softening effect, wrinkle resistance; or that reduces damaging or negative effects that can occur during cleaning and/or conditioning and/or wearing, such as e.g. fading, graying, etc.

The textile-care compound can encompass, for example, a textile-softening compound, bleaching agents, bleach activators, enzymes, silicone oils, anti-redeposition agents, optical brighteners, graying inhibitors, shrinkage preventers, wrinkle-prevention agents, color transfer inhibitors, antimicrobial active substances, germicides, fungicides, antioxidants, antistatic agents, ironing adjuvants, proofing and impregnation agents, swelling and anti-slip agents, UV absorbers, and mixtures thereof. Concrete examples of these textile-care compounds may be found in the description of the laundry detergent or cleaning agent according to the present invention, and can also be used in the solid textile-care composition.

The textile-care compound is by preference a textile-softening compound, and is for example a polysiloxane, a textile-softening clay, a cationic polymer, or a mixture of at least two of said textile-softening compounds. The textile-care composition is accordingly, by preference, a textile-softening composition.

A polysiloxane that is usable in preferred fashion comprises at least the following structural unit:

a)

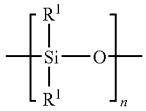

in which $R^1$=(mutually independently) $C_1$ to $C_{30}$ alkyl, by preference $C_1$ to $C_4$ alkyl, in particular methyl or ethyl, n=1 to 5000, by preference 10 to 2500, in particular 100 to 1500.

It may be preferred for the polysiloxane also to comprise, additionally, the following structural unit:

b)

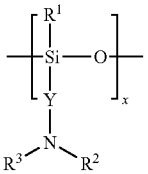

in which $R^1$=$C_1$ to $C_{30}$ alkyl, by preference $C_1$ to $C_4$ alkyl, in particular methyl or ethyl, Y=optionally substituted, linear or branched $C_1$ to $C_{20}$ alkylene, by preference —$(CH_2)_m$— where m=1 to 16, by preference 1 to 8, in particular 2 to 4, especially 3, $R^2$, $R^3$=(mutually independently) H or optionally substituted, linear or branched $C_1$ to $C_{30}$ alkyl, by preference $C_1$ to $C_{30}$ alkyl substituted with amino groups, particularly preferably —$(CH_2)_b$—$NH_2$ where b=1 to 10, extremely preferably b=2, x=1 to 5000, by preference 10 to 2500, in particular 100 to 1500.

If the polysiloxane comprises only structural unit a) in which $R^1$=methyl, this is a polydimethylsiloxane. Polydimethylsiloxanes are known as efficient textile-softening compounds.

Suitable polydimethylsiloxanes encompass DC-200 (from Dow Corning), Baysilone® M 50, Baysilone® M 100, Baysilone® M 350, Baysilone® M 500, Baysilone® M 1000, Baysilone® M 1500, Baysilone® M 2000, or Baysilone® M 5000 (all from GE Bayer Silicones).

It may also be preferred, however, for the polysiloxane to contain structural units a) and b). A particularly preferred polysiloxane exhibits the following structure:

$$(CH_3)_3Si—[O—Si(CH_3)_2]_n—[O—Si(CH_3)\{(CH_2)_3—NH—(CH_2)_2—NH_2\}]_x—OSi(CH_3)_3,$$

the sum n+x being a number between 2 and 10,000.

Suitable polysiloxanes having structural units a) and b) are obtainable commercially, for example, under the trade names DC2-8663, DC2-8035, DC2-8203, DC05-7022, or DC2-8566 (all from Dow Corning). Also suitable according to the present invention are, for example, the commercially obtainable products Dow Corning® 7224, Dow Corning® 929 Cationic Emulsion, or Formasil 410 (GE Silicones).

A suitable textile-softening clay is, for example, a smectite clay. Preferred smectite clays are beidellite clays, hectorite clays, laponite clays, montmorillonite clays, nontronite clays, saponite clays, sauconite clays, and mixtures thereof. Montmorillonite clays are the preferred softening clays. Bentonites contain principally montmorillonites, and can serve as a preferred source for the textile-softening clay.

Suitable bentonites are marketed, for example, under the designation Laundrosil® by the Süd-Chemie company, or under the designation Detercal by the Laviosa company.

Suitable cationic polymers encompass, in particular, those that are described in the "CTFA International Cosmetic Ingredient Dictionary", fourth edition, J. M. Nikitakis et al., editors, published by the Cosmetic, Toiletry, and Fragrance Association, 1991, and grouped under the general designation "polyquaternium." Some suitable polyquaternium compounds are described in more detail below.

POLYQUATERNIUM-1 (CAS no. 68518-54-7)

Definition: $\{(HOCH_2CH_2)_3N^+—CH_2CH=CHCH_2—[N^+(CH_3)_2—CH_2CH=CHCH_2]_x—N^+(CH_2CH_2OH)_3\}[Cl^-]_{x+2}$ POLYQUATERNIUM-2 (CAS no. 63451-27-4)

Definition: $[—N(CH_3)_2—CH_2CH_2CH_2—NH—C(O)—NH—CH_2CH_2CH_2—N(CH_3)_2—CH_2CH_2OCH_2CH_2—]^{2+}(Cl^-)_2$ Obtainable, for example, as Mirapol® A-15 (from Rhodia).

POLYQUATERNIUM-3

Definition: Copolymer of acrylamide and trimethylammonium ethylmethacrylate methosulfate.

POLYQUATERNIUM-4 (CAS no. 92183-41-0)

Definition: Copolymer of hydroxyethyl cellulose and diallyldimethylammonium chloride.

Obtainable, for example, as Celquat® H 100 or Celquat® L200 (from National Starch).

POLYQUATERNIUM-5 (CAS no. 26006-22-4)

Definition: Copolymer of acrylamide and 1-methacrylyloxyethyltrimethylammonium methosulfate. Obtainable, for example, as Nalco 7113 (from Nalco) or Reten® 210, Reten® 220, Reten® 230, Reten® 240, Reten® 1104, Reten® 1105, or Reten® 1106 (all from Hercules).

POLYQUATERNIUM-6 (CAS no. 26062-79-3) Definition: Polymer of dimethyldiallylammonium chloride. Obtainable, for example, as Merquat® 100 (from Ondeo-Nalco).

POLYQUATERNIUM-7 (CAS no. 26590-05-6)

Definition: Polymeric quaternary ammonium salt made up of acrylamide and dimethyldiallylammonium chloride monomers.

Obtainable, for example, as Merquat® 550 or Merquat® S (from Ondeo-Nalco).

POLYQUATERNIUM-8

Definition: Polymeric quaternary ammonium salt of methyl- and stearyldimethylaminoethyl methacrylate that has been quaternized with dimethyl sulfate.

POLYQUATERNIUM-9

Definition: Polymeric quaternary ammonium salt of polydimethylaminoethyl methacrylate that has been quaternized with methyl bromide.

POLYQUATERNIUM-10 (CAS nos. 53568-66-4; 55353-19-0; 54351-50-7; 81859-24-7; 68610-92-4; 81859-24-7)

Definition: Polymeric quaternary ammonium salt of hydroxyethyl cellulose that has been reacted with a trimethylammonium-substituted epoxide.

Obtainable, for example, as Celquat® SC-240 (from National Starch), UCARE® Polymer JR-125, UCARE® Polymer JR-400, UCARE® Polymer JR-30M, UCARE® Polymer LR 400, UCARE® Polymer LR 30M, Ucare® Polymer SR-10 (all from Amerchol).

POLYQUATERNIUM-11 (CAS no. 53633-54-8)

Definition: Quaternary ammonium polymer that is formed by reacting diethyl sulfate with the copolymer of vinylpyrrolidone and dimethylaminoethyl methacrylate. Obtainable, for example, as Luviquat® PQ 11 PN (from BASF), Gafquat® 734, Gafquat® 755, or Gafquat® 755N (from GAF).

POLYQUATERNIUM-12 (CAS no. 68877-50-9)

Definition: Quaternary ammonium polymer salt obtainable by reacting ethyl methacrylate/abietyl methacrylate/diethylaminoethyl methacrylate copolymer with dimethyl sulfate.

POLYQUATERNIUM-13 (CAS no. 68877-47-4)

Definition: Polymeric quaternary ammonium salt obtainable by reacting ethylmethacrylate/oleyl methacrylate/diethylaminoethyl methacrylate copolymer with dimethyl sulfate.

POLYQUATERNIUM-14 (CAS no. 27103-90-8)

Definition: Polymeric quaternary ammonium salt having the formula $—\{—CH_2—C—(CH_3)—[C(O)O—CH_2CH_2—N(CH_3)_3—]\}_x^+[CH_3SO_4]^-_x$.

POLYQUATERNIUM-15 (CAS no. 35429-19-7)

Definition: Copolymer of acrylamide and β-methacrylyloxyethyltrimethylammonium chloride.

POLYQUATERNIUM-16 (CAS no. 95144-24-4)

Definition: Polymeric quaternary ammonium salt formed from methylvinylimidazolium chloride and vinylpyrrolidone.

Obtainable, for example, as Luviquat® FC 370, Luviquat® Style, Luviquat® FC 550, or Luviquat® Excellence (all from BASF).

POLYQUATERNIUM-17 (CAS no. 90624-75-2)

Definition: Polymeric quaternary ammonium salt obtainable by reacting adipic acid and dimethylaminopropylamine with dichloroethyl ether.

Obtainable, for example, as Mirapol® AD-1 (from Rhodia).

POLYQUATERNIUM-18

Definition: Polymeric quaternary ammonium salt obtainable by reacting azelaic acid and dimethylaminopropylamine with dichloroethyl ether.

Obtainable, for example, as Mirapol® AZ-1 (from Rhodia).

POLYQUATERNIUM-19

Definition: Polymeric quaternary ammonium salt obtainable by reacting polyvinyl alcohol with 2,3-epoxypropylamine.

POLYQUATERNIUM-20

Definition: Polymeric quaternary ammonium salt obtainable by reacting polyvinyloctadecyl ether with 2,3-epoxypropylamine.

POLYQUATERNIUM-21 (CAS no. 102523-94-4)

Definition: Polysiloxane/polydimethyldialkylammonium acetate copolymer.

Obtainable, for example, as Abil® B 9905 (from Goldschmidt-Degussa).

POLYQUATERNIUM-22 (CAS no. 53694-17-0)

Definition: Dimethyldiallylammonium chloride/acrylic acid copolymer.

Obtainable, for example, as Merquat® 280 (from Ondeo-Nalco).

POLYQUATERNIUM-24 (CAS no. 107987-23-5)

Definition: Polymeric quaternary ammonium salt resulting from the reaction of hydroxyethyl cellulose with a lauryidimethylammonium-substituted epoxide.

Obtainable, for example, as Quatrisoft.

POLYQUATERNIUM-27

Definition: Block copolymer resulting from the reaction of polyquaternium-2 with polyquaternium-17.

POLYQUATERNIUM-28 (CAS no. 131954-48-8)

Definition: Vinylpyrrolidone/methacrylamidopropyltrimethylammonium chloride copolymer.

Obtainable, for example, as Gafquat® HS-100 (from GAF).

POLYQUATERNIUM-29

Definition: Chitosan that has been reacted with propylene oxide and quaternized with epichlorohydrin.

POLYQUATERNIUM-30

Definition: Polymeric quaternary ammonium salt having the formula $—[CH_2C(CH_3)(C(O)OCH_3)]_x—[CH_2C(CH_3)(C(O)OCH_2CH_2N^+(CH_3)_2CH_2COO^-)]_y—$.

POLYQUATERNIUM-31 (CAS no. 136505-02-7)

POLYQUATERNIUM-32 (CAS no. 35429-19-7)

Definition: Polymer of N,N,N-trimethyl-2-[(2-methyl-1-oxo-2-propenyl)oxy]ethanaminium chloride with 2-propenamide.

POLYQUATERNIUM-37 (CAS no. 26161-33-1)

Definition: Homopolymer of methacryloyltrimethyl chloride.

Obtainable, for example, as Synthalen® CR (from 3V Sigma).

POLYQUATERNIUM-44 (CAS no. 150595-70-5)

Definition: Quaternized ammonium salt of the copolymer of vinylpyrrolidone and quaternized imidazoline.

Obtainable, for example, as Luviquat® Ultracare (from BASF).

POLYQUATERNIUM-68 (CAS no. 827346-45-2)

Definition: Quaternized copolymer of vinylpyrrolidone, methacrylamide, vinylimidazole, and quaternized vinylimidazole.

Obtainable, for example, as Luviquat® Supreme (from BASF).

It may be preferred for the textile-care composition to contain a textile-softening compound and one or more further textile-care compound(s).

The quantity of textile-care compound in the textile-care composition is 0.1 to 10 wt %, and preferably between 1 and 6 wt %.

A further essential constituent of the textile care composition is the perfume. Individual odorant compounds, e.g. the synthetic products of the ester, ether, aldehyde, ketone, alcohol, and hydrocarbon types, can be used as perfume oils or fragrances. It is preferable, however, to use mixtures of different odorants that together produce an appealing fragrance note. Perfume oils of this kind can also contain natural odorant mixtures such as those accessible from plant sources.

The quantity of perfume in the textile-care composition is by preference between 0.1 and 20 wt %, particularly preferably between 1 and 10 wt %, and very particularly preferably between 2 and 7 wt %.

The textile-care composition according to the present invention can optionally contain further ingredients.

In order to improve the aesthetic impression of the textile-care composition, it can be colored with suitable dyes. Preferred dyes, the selection of which will present no difficulty whatsoever to one skilled in the art, possess excellent shelf stability and insensitivity to the other ingredients of the laundry detergents or cleaning agents and to light, and no pronounced substantivity with respect to textile fibers, in order not to color them.

The textile-care composition can furthermore contain a filler, such as silica. The quantity of filler can be between 0.1 and 10 wt %, and is preferably 1 to 5 wt %.

In order to increase luster, the textile-care composition can also contain a luster agent. Examples of suitable luster agents are ethylene glycol mono- and distearate (e.g. Cutina® AGS of Cognis), as well as PEG-3 distearate.

In order to prevent discoloration of the matrix of soap, a chelating agent can be added, in a quantity from 0.01 to 0.03 wt %, to the matrix as a further ingredient. Suitable chelating agents encompass ethylendiaminetetraacetic acid (EDTA) or (1-hydroxyethylidene)diphosphonic acid (HEDP).

The textile-care composition can furthermore contain a skin-care compound.

A "skin-care compound" is understood as a compound or mixture of compounds that, upon contact between a textile and the solid textile- and/or skin-care composition, absorbs onto the textile and, upon contact between the textile and skin, imparts to the skin an advantage compared with a textile that was not treated with the textile- and/or skin-care composition according to the present invention. This advantage can encompass, for example, transfer of the skin-care compound from the textile onto the skin, a decreased transfer of water from the skin onto the textile, or decreased friction on the skin surface as a result of the textile.

The skin-care compound is by preference hydrophobic, can be liquid or solid, and must be compatible with the other ingredients of the solid textile- and/or skin-care composition. The skin-care compound can encompass, for example a) waxes such as carnauba, spermaceti, beeswax, lanolin, derivatives thereof and mixtures thereof;
b) plant extracts, for example vegetable oils such as avocado oil, olive oil, palm oil, palm kernel oil, rapeseed oil, linseed oil, soy oil, peanut oil, coriander oil, castor oil, poppy-seed oil, cocoa oil, coconut oil, pumpkin seed oil, wheat germ oil, sesame oil, sunflower oil, almond oil, macadamia nut oil, apricot kernel oil, hazelnut oil, jojoba oil or canola oil, chamomile, aloe vera, and mixtures thereof;
c) higher fatty acids such as lauric acid, myristic acid, palmitic acid, stearic acid, behenic acid, oleic acid, linoleic acid, isostearic acid, or polyunsaturated fatty acids;
d) higher fatty alcohols such as lauryl alcohol, cetyl alcohol, stearyl alcohol, oleyl alcohol, behenyl alcohol, or 2-hexadecanol;
e) esters such as cetyl octanoate, lauryl lactate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactate, alkyl citrate, or alkyl tartrate;

f) hydrocarbons such as paraffins, mineral oils, squalane, or squalene;

g) lipids;

h) vitamins such as vitamin A, C, or E, or vitamin alkyl esters;

i) phospholipids;

j) sun protectants such as octyl methoxycinnamate and butylmethoxybenzoylmethane;

k) silicone oils, such as linear or cyclic polydimethylsiloxanes, amino-, alkyl-, alkylaryl-, or aryl-substituted silicone oils; and l) mixtures thereof.

It is preferred that the textile-care composition exhibit particle sizes in the range from 0.6 to 30 mm, in particular 0.8 to 7 mm, and particularly preferably 1 to 3 mm. It is additionally preferred that the textile-care composition be an extrudate.

For manufacture of the textile-care composition, the soap(s), the textile-care compound, the perfume, and if applicable further ingredients, are mixed, and the mixture obtained is then extruded through a rhomboidal orifice plate.

The textile-care composition according to the present invention is suitable in particular for conditioning textile fabrics, and for that purpose is brought into contact, along with a conventional laundry detergent or cleaning agent, with the textile fabrics in the (main) washing cycle of a conventional washing and cleaning process.

The textile-care composition can be introduced into a laundry detergent or cleaning agent.

For this purpose, a solid laundry detergent or cleaning agent is mixed with 0.1 to 20 wt %, by preference 1 to 10 wt %, of the textile-care composition according to the present invention.

The laundry detergents or cleaning agents according to the present invention contain surfactant(s) in addition to the textile-care composition; anionic, nonionic, zwitterionic, and/or amphoteric surfactants can be used. Mixtures of anionic and nonionic surfactants are preferred from the standpoint of applications engineering. The total surfactant content of a laundry detergent is by preference below 40 wt % and particularly preferably below 35 wt %, based on the entire laundry detergent.

The nonionic surfactants used are preferably alkoxylated, advantageously ethoxylated, in particular primary alcohols having by preference 8 to 18 carbon atoms and an average of 1 to 12 mol ethylene oxide (EO) per mol of alcohol, in which the alcohol radical can be linear or preferably methyl-branched in the 2-position, or can contain mixed linear and methyl-branched radicals, such as those that are usually present in oxo alcohol radicals. Particularly preferred, however, are alcohol ethoxylates having linear radicals made up of alcohols of natural origin having 12 to 18 carbon atoms, e.g. from coconut, palm, tallow, or oleyl alcohol, and an average of 2 to 8 EO per mol of alcohol. The preferred ethoxylated alcohols include, for example, $C_{12-14}$ alcohols having 3 EO or 4 EO, $C_{9-11}$ alcohol having 7 EO, $C_{13-15}$ alcohols having 3 EO, 5 EO, 7 EO, or 8 EO, $C_{12-18}$ alcohols having 3 EO, 5 EO, or 7 EO, and mixtures thereof, such as mixtures of $C_{12-14}$ alcohol having 3 EO and $C_{12-18}$ alcohol having 7 EO. The degrees of ethoxylation indicated represent statistical averages, which can correspond to an integer or a fraction for a specific product. Preferred alcohol ethoxylates exhibit a restricted distribution of homologs (narrow range ethoxylates, NRE). In addition to these nonionic surfactants, fatty alcohols having more than 12 EO can also be used. Examples of these are tallow fatty alcohol having 14 EO, 25 EO, 30 EO, or 40 EO. Nonionic surfactants that contain EO and PO groups together in the molecule are also usable according to the present invention. Block copolymers having EO-PO block units or PO-EO block units, but also EO-PO-EO copolymers or PO-EO-PO copolymers, can be used in this context. Also usable, of course, are mixed alkoxylated nonionic surfactants in which EO and PO units are distributed statistically rather than in block fashion. Such products are obtainable by the simultaneous action of ethylene oxide and propylene oxide on fatty alcohols.

Also usable as further nonionic surfactants are alkyl glycosides of the general formula $RO(G)_x$, in which R denotes a primary straight-chain or methyl-branched (in particular methyl-branched in the 2-position) aliphatic radical having 8 to 22, by preference 12 to 18 carbon atoms; and G is the symbol denoting a glycose unit having 5 or 6 carbon atoms, preferably glucose. The degree of oligomerization x, which indicates the distribution of monoglycosides and oligoglycosides, is any number between 1 and 10; by preference, x is between 1.2 and 1.4. Alkyl glycosides are known mild surfactants.

A further class of nonionic surfactants used in preferred fashion, which are used either as the only nonionic surfactant or in combination with other nonionic surfactants, are alkoxylated, preferably ethoxylated or ethoxylated and propoxylated, fatty acid alkyl esters, by preference having 1 to 4 carbon atoms in the alkyl chain, in particular fatty acid methyl esters.

Nonionic surfactants of the amine oxide type, for example N-cocalkyl-N,N-dimethylamine oxide and N-tallowalkyl-N,N-dihydroxyethylamine oxide, and the fatty acid alkanolamides, can also be suitable. The quantity of these nonionic surfactants is by preference no more than that of the ethoxylated fatty alcohols, in particular no more than half thereof.

Further suitable surfactants are polyhydroxy fatty acid amides of formula (VII)

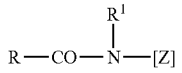

(VII)

in which RCO denotes an aliphatic acyl radical having 6 to 22 carbon atoms; $R^1$ denotes hydrogen, an alkyl or hydroxyalkyl radical having 1 to 4 carbon atoms; and [Z] denotes a linear or branched polyhydroxyalkyl radical having 3 to 10 carbon atoms and 3 to 10 hydroxyl groups. The polyhydroxy fatty acid amides are known substances that can usually be obtained by reductive amination of a reducing sugar with ammonia, an alkylamine, or an alkanolamine, and subsequent acylation with a fatty acid, a fatty acid alkyl ester, or a fatty acid chloride.

Also belonging to the group of the polyhydroxy fatty acid amides are compounds of formula (VIII)

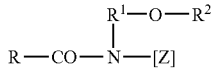

(VIII)

in which R denotes a linear or branched alkyl or alkenyl radical having 7 to 12 carbon atoms; $R^1$ denotes a linear, branched, or cyclic alkyl radical or an aryl radical having 2 to 8 carbon atoms; and $R^2$ denotes a linear, branched, or cyclic alkyl radical or an aryl radical or an oxyalkyl radical having 1 to 8 carbon atoms, $C_{1-4}$ alkyl or phenyl radicals being preferred; and [Z] denotes a linear polyhydroxyalkyl radical whose alkyl chain is substituted with at least two hydroxyl groups, or alkoxylated, preferably ethoxylated or propoxylated, derivatives of that radical.

[Z] is preferably obtained by reductive amination of a reducing sugar, for example glucose, fructose, maltose, lactose, galactose, mannose, or xylose. The N-alkoxy- or N-aryloxy-substituted compounds can then be converted into the desired polyhydroxy fatty acid amides by reaction with fatty acid methyl esters in the presence of an alkoxide as catalyst.

The concentration of nonionic surfactants in the laundry detergents or cleaning agents is preferably 5 to 30 wt %, by preference 7 to 20 wt %, and in particular 9 to 15 wt %, based in each case on the entire laundry detergent or cleaning agent.

Anionic surfactants that can be used are, for example, those of the sulfonate and sulfate types. Possibilities as surfactants of the sulfonate type are, by preference, $C_{9-13}$ alkylbenzenesulfonates, olefinsulfonates, i.e. mixtures of alkene- and hydroxyalkanesulfonates, and disulfonates, for example such as those obtained from $C_{12-18}$ monoolefins having an end-located or internal double bond, by sulfonation with gaseous sulfur trioxide and subsequent alkaline or acid hydrolysis of the sulfonation products. Also suitable are alkanesulfonates that are obtained from $C_{12-18}$ alkanes, for example by sulfochlorination or sulfoxidation with subsequent hydrolysis and neutralization. The esters of α-sulfo fatty acids (estersulfonates), e.g. the α-sulfonated methyl esters of hydrogenated coconut, palm kernel, or tallow fatty acids, are likewise suitable.

Further suitable anionic surfactants are sulfonated fatty acid glycerol esters. "Fatty acid glycerol esters" are to be understood as the mono-, di- and triesters, and mixtures thereof, that are obtained during the production by esterification of a monoglycerol with 1 to 3 mol fatty acid, or upon transesterification of triglycerides with 0.3 to 2 mol glycerol. Preferred sulfonated fatty acid glycerol esters are the sulfonation products of saturated fatty acids having 6 to 22 carbon atoms, for example hexanoic acid, octanoic acid, decanoic acid, myristic acid, lauric acid, palmitic acid, stearic acid, or behenic acid.

Preferred alk(en)yl sulfates are the alkali, and in particular sodium, salts of the sulfuric acid semi-esters of the $C_{12}$-$C_{18}$ fatty alcohols, for example from coconut fatty alcohol, tallow fatty alcohol, lauryl, myristyl, cetyl, or stearyl alcohol, or the $C_{10}$-$C_{20}$ oxo alcohols, and those semi-esters of secondary alcohols of those chain lengths. Additionally preferred are alk(en)yl sulfates of the aforesaid chain length that contain a synthetic straight-chain alkyl radical produced on a petrochemical basis, which possess a breakdown behavior analogous to those appropriate compounds based on fat-chemistry raw materials. For purposes of washing technology, the $C_{12}$-$C_{16}$ alkyl sulfates and $C_{12}$-$C_{15}$ alkyl sulfates, as well as $C_{14}$-$C_{15}$ alkyl sulfates, are preferred. 2,3-Alkyl sulfates that can be obtained, for example, as commercial products of the Shell Oil Company under the name DAN®, are also suitable anionic surfactants.

The sulfuric acid monoesters of straight-chain or branched $C_{7-21}$ alcohols ethoxylated with 1 to 6 mol ethylene oxide, such as 2-methyl-branched $C_{9-11}$ alcohols having an average of 3.5 mol ethylene oxide (EO) or $C_{12-18}$ fatty alcohols having 1 to 4 EO, are also suitable. Because of their high foaming characteristics they are used in cleaning agents only in relatively small quantities, for example in quantities from 1 to 5 wt %.

Other suitable anionic surfactants are also the salts of alkylsulfosuccinic acid, which are also referred to as sulfosuccinates or as sulfosuccinic acid esters and represent the monoesters and/or diesters of sulfosuccinic acid with alcohols, preferably fatty alcohols, and in particular ethoxylated fatty alcohols. Preferred sulfosuccinates contain $C_{8-18}$ fatty alcohol radicals or mixtures thereof. Particularly preferred sulfosuccinates contain a fatty alcohol radical that is derived from ethoxylated fatty alcohols that, considered per se, represent nonionic surfactants. Sulfosuccinates whose fatty alcohol radicals derive from ethoxylated fatty alcohols having a restricted homolog distribution are, in turn, particularly preferred. It is likewise also possible to use alk(en)ylsuccinic acid having by preference 8 to 18 carbon atoms in the alk(en)yl chain, or salts thereof.

Particularly preferred anionic surfactants are soaps. Saturated and unsaturated fatty acid soaps, such as the salts of lauric acid, myristic acid, palmitic acid, stearic acid, (hydrogenated) erucic acid, and behenic acid, are suitable, as are soap mixtures derived in particular from natural fatty acids, e.g. coconut, palm-kernel, olive-oil, or tallow fatty acids.

The anionic surfactants, including the soaps, can be present in the form of their sodium, potassium, or ammonium salts, and as soluble salts of organic bases, such as mono-, di-, or triethanolamine. The anionic surfactants are preferably present in the form of their sodium or potassium salts, in particular in the form of the sodium salts.

The concentration of anionic surfactants in preferred laundry detergents or cleaning agents is 2 to 30 wt %, by preference 4 to 25 wt %, and in particular 5 to 22 wt %, based in each case on the entire laundry detergent or cleaning agent.

In addition to the textile-care composition and the surfactants, the laundry detergents or cleaning agents can contain further ingredients that further improve the aesthetic and/or applications-engineering properties of the laundry detergent or cleaning agent. In the context of the present invention, preferred laundry detergents or cleaning agents additionally contain one or more substances from the group of the detergency builders, bleaching agents, bleach activators, enzymes, perfumes, perfume carriers, fluorescing agents, dyes, foam inhibitors, silicone oils, anti-redeposition agents, optical brighteners, graying inhibitors, shrinkage preventers, wrinkle protection agents, color transfer inhibitors, antimicrobial active substances, germicides, fungicides, antioxidants, preservatives, corrosion inhibitors, antistatic agents, bittering agents, ironing adjuvants, proofing and impregnation agents, swelling and anti-slip agents, neutral filler salts, and UV absorbers.

Silicates, aluminum silicates (in particular zeolites), carbonates, salts of organic di- and polycarboxylic acids, and mixtures of these substances, may be mentioned in particular as detergency builders that can be contained in the laundry detergents or cleaning agents.

Suitable crystalline, sheet-form sodium silicates possess the general formula $NaMSi_xO_{2x+1}$. $H_2O$, where M denotes sodium or hydrogen, x is a number from 1.9 to 4, and y is a number from 0 to 20, and preferred values for x are 2, 3, or 4. Preferred crystalline sheet silicates of the formula indicated above are those in which M denotes sodium and x assumes the value 2 or 3. Both β- and δ-sodium disilicates $Na_2Si_2O_5.yH_2O$ are particularly preferred.

Also usable are amorphous sodium silicates having a $Na_2O:SiO_2$ modulus of 1:2 to 1:3.3, preferably 1:2 to 1:2.8, and in particular 1:2 to 1:2.6, which are dissolution-delayed and exhibit secondary washing properties. A dissolution delay as compared with conventional amorphous sodium silicates can have been brought about in various ways, for example by surface treatment, compounding, compacting/densification, or overdrying. In the context of this invention, the term "amorphous" is also understood to mean "X-amorphous." In other words, in X-ray diffraction experiments the silicates yield not the sharp X-ray reflections that are typical of crystalline substances, but at most one or more maxima in the scattered X radiation that have a width of several degree units of the diffraction angle. Particularly good builder properties can, however, very easily be obtained even if the silicate particles yield blurred or even sharp diffraction maxima in electron beam diffraction experiments. This may be interpreted to mean that the products comprise microcrystalline regions 10 to several hundred nm in size, values of up to a maximum of 50 nm, and in particular a maximum of 20 nm, being preferred. Densified/compacted amorphous silicates, compounded amorphous silicates, and overdried X-amorphous silicates are particularly preferred.

The finely crystalline synthetic zeolite containing bound water that is used is by preference zeolite A and/or zeolite P. Zeolite MAP® (commercial product of the Crosfield Co.) is particularly preferred as zeolite P. Also suitable, however, are zeolite X as well as mixtures of A, X, and/or P. Also commercially available and preferably usable in the context of the present invention is, for example, a co-crystal of zeolite X and zeolite A (approx. 80 wt % zeolite X) that is marketed by the Sasol company under the trade name VEGOBOND AX® and can be described by the formula $$n\mathrm{Na_2O}.(1-n)\mathrm{K_2O}.\mathrm{Al_2O_3}.(2\text{-}2.5)\mathrm{SiO_2}.(3.5\text{-}5.5)\mathrm{H_2O}$$

n=0.90-1.0

The zeolite can be used as a spray-dried powder or also as an undried stabilized suspension still moist as manufactured. In the event the zeolite is used as a suspension, it can contain small additions of nonionic surfactants as stabilizers, for example 1 to 3 wt %, based on the zeolite, of ethoxylated $C_{12}$-$C_{18}$ fatty alcohols having 2 to 5 ethylene oxide groups, $C_{12}$-$C_{14}$ fatty alcohols having 4 to 5 ethylene oxide groups, or ethoxylated isotridecanols. Suitable zeolites exhibit an average particle size of less than 10 μm (volume distribution; measurement method: Coulter Counter), and preferably contain 18 to 22 wt %, in particular 20 to 22 wt %, bound water.

Use of the commonly known phosphates as builder substances is also possible, of course, provided such use is not to be avoided for environmental reasons. The sodium salts of the orthophosphates, of the pyrophosphates, and in particular of the tripolyphosphates are particularly suitable.

Organic builders that can be present in the laundry detergents or cleaning agents encompass polycarboxylate polymers such as polyacrylates and acrylic acid/maleic acid copolymers, polyaspartates, and monomeric polycarboxylates such as citrates, gluconates, succinates, or malonates, which by preference are used as sodium salts.

Among the compounds that serve as bleaching agents and yield $H_2O_2$ in water, sodium perborate tetrahydrate and sodium perborate monohydrate are particularly important. Other usable bleaching agents are, for example, sodium percarbonate, peroxypyrophosphates, citrate perhydrates, and peracid salts or peracids that yield $H_2O_2$, such as perbenzoates, peroxophthalates, diperazelaic acid, phthaloimino peracid, or diperdodecanedioic acid.

To achieve an improved bleaching effect when washing at temperatures of 60° C. and below, bleach activators can be incorporated into the laundry detergents or cleaning agents. Compounds that, under perhydrolysis conditions, yield aliphatic peroxycarboxylic acids having by preference 1 to 10 carbon atoms, in particular 2 to 4 carbon atoms, and/or optionally substituted perbenzoic acid, can be used as bleach activators. Substances that carry O- and/or N-acyl groups having the aforesaid number of carbon atoms, and/or that carry optionally substituted benzoyl groups, are suitable. Multiply acylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetyl glycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic acid anhydrides, in particular phthalic acid anhydride, acylated polyvalent alcohols, in particular triacetin, ethylene glycol diacetate, and 2,5-diacetoxy-2,5-dihydrofuran, are preferred.

In addition to or instead of the conventional bleach activators, so-called bleach catalysts can also be incorporated into the laundry detergents or cleaning agents. These substances are bleach-intensifying transition-metal salts or transition-metal complexes such as, for example, Mn, Fe, Co, Ru, or Mo salt complexes or carbonyl complexes. Mn, Fe, Co, Ru, Mo, Ti, V, and Cu complexes having nitrogen-containing tripod ligands, as well as Co, Fe, Cu, and Ru amine complexes, are also applicable as bleach catalysts.

The laundry detergent or cleaning agent can contain enzymes, in encapsulated form and/or directly in the laundry detergent or cleaning agent. Suitable enzymes are, in particular, those in the classes of hydrolases, such as proteases, esterases, lipases or lipolytically active enzymes, amylases, cellulases and other glycosyl hydrolases, hemicellulase, cutinases, β-glucanases, oxidases, peroxidases, perhydrolases, mannanases, and/or laccases, and mixtures of the aforesaid enzymes. All these hydrolases contribute, in the laundry, to the removal of stains such as protein-, grease-, or starch-containing stains, and graying. Cellulases and other glycosyl hydrolases can moreover contribute to color retention and to enhanced textile softness by removing pilling and microfibrils. Oxidoreductases can also be used for bleaching and to inhibit color transfer. Enzymatic active substances obtained from bacterial strains or fungi, such as *Bacillus subtilis, Bacillus licheniformis, Streptomyceus griseus*, and *Humicola insolens*, are particularly suitable. Proteases of the subtilisin type, and in particular proteases obtained from *Bacillus lentus*, are preferably used. Enzyme mixtures, for example of protease and amylase or protease and lipase or lipolytically active enzymes, or protease and cellulase, or of cellulase and lipase or lipolytically active enzymes, or of protease, amylase, and lipase or lipolytically active enzymes, or protease, lipase or lipolytically active enzymes, and cellulase, but in particular protease- and/or lipase-containing mixtures or mixtures with lipolytically active enzymes, are of particular interest in this context. Examples of such lipolytically active enzymes are the known cutinases. Peroxidases or oxidases have also proven suitable in certain cases. The suitable amylases include, in particular, α-amylases, isoamylases, pullulanases, and pectinases. Cellobiohydrolases, endoglucanases, and β-glucosidases, which are also called cellobiases, and mixtures thereof, are preferably used as cellulases. Because different types of cellulase differ in terms of their CMCase and avicelase activities, the desired activities can be adjusted by means of controlled mixtures of the cellulases The enzymes can be adsorbed onto carrier materials in order to protect them from premature breakdown. The proportion of enzymes or enzyme granules directly in the laundry detergent or cleaning agent can be, for example, approximately 0.01 to 5 wt %, by preference 0.12 to approximately 2.5 wt %.

It may also be preferred, however, for example in special laundry detergents or cleaning agents for consumers with allergies and/or sensitive skin, for the laundry detergent or cleaning agent to contain no enzymes.

In an embodiment, the laundry detergent or cleaning agent contains, if applicable, one or more perfumes in a quantity of usually up to 10 wt %, by preference 0.5 to 7 wt %, in particular 1 to 3 wt %. The quantity of perfume used also depends on the type of laundry detergent or cleaning agent. It is, however, particularly preferred that the perfume be introduced into the laundry detergent or cleaning agent via the textile-softening composition. It is nevertheless also possible for the laundry detergent or cleaning agent to contain perfume that is not introduced into the laundry detergent or cleaning agent via the textile-softening composition.

In order to improve the aesthetic impression of the laundry detergents or cleaning agents, they can be colored (also only in part, if applicable) with suitable dyes. Preferred dyes, the selection of which will present no difficulty whatsoever to one skilled in the art, possess excellent shelf stability and insensitivity to the other ingredients of the laundry detergents or cleaning agents and to light, and no pronounced substantivity with respect to textile fibers, in order not to color them.

Appropriate foam inhibitors that can be used in the laundry detergents or cleaning agents are, for example, soaps, paraffins, or silicone oils, which optionally can be applied onto carrier materials.

Suitable soil release polymers, which are also referred to as "anti-redeposition agents," are, for example, nonionic cellulose ethers such as methyl cellulose and methylhydroxypropyl cellulose having a 15 to 30 wt % proportion of methoxy groups and a 1 to 15 wt % proportion of hydroxypropyl groups, based in each case on the nonionic cellulose ethers, as well as polymers, known from the existing art, of phthalic acid and/or terephthalic acid and of their derivatives, in particular polymers of ethylene terephthalates and/or polyethylene glycol terephthalates or anionically and/or nonionically modified derivatives thereof. Suitable derivatives encompass the sulfonated derivates of phthalic acid polymers and terephthalic acid polymers. A further class of suitable soil release polymers, in particular for cotton-containing textiles, is represented by modified, for example alkoxylated and/or quaternized and/or oxidized, polyamines. The polyamines are, for example, polyalkyleneamines such as polyethyleneamines, or polyalkyleneimines such as polyethyleneimines. Preferred examples of this class of soil release polymers are ethoxylated polyethyleneimines and ethoxylated polyethyleneamines.

Optical brighteners (so-called "whiteners") can be added to the laundry detergents or cleaning agents in order to eliminate graying and yellowing of the treated textile fabrics. These substances absorb onto the fibers and cause brightening and a simulated bleaching effect by converting invisible ultraviolet radiation into longer-wave visible light, the ultraviolet light absorbed from sunlight being emitted as slightly bluish fluorescence and resulting, with the yellow tone of the grayed or yellowed laundry, in pure white. Suitable compounds derive, for example, from the substance classes of the 4,4'-diamino-2,2'-stilbenedisulfonic acids (flavonic acids), 4,4'-distyrylbiphenyls, methylumbelliferones, cumarins, dihydroquinolinones, 1,3-diarylpyrazolines, naphthalic acid imides, benzoxazole, benzisoxazole, and benzimidazole systems, and pyrene derivatives substituted with heterocycles. The optical brighteners are usually used in quantities of between 0.05 and 0.3 wt % based on the finished laundry detergent or cleaning agent.

The purpose of graying inhibitors is to keep dirt released from the fibers suspended in the bath, thus preventing the dirt from redepositing. Water-soluble colloids, usually organic in nature, are suitable for this, for example size, gelatin, salts of ethersulfonic acids of starch or of cellulose, or salts of acid sulfuric acid esters of cellulose or starch. Water-soluble polyamides containing acid groups are also suitable for this purpose. Soluble starch preparations, and starch products other than those mentioned above, can also be used, e.g. degraded starch, aldehyde starches, etc. Polyvinylpyrrolidone is also usable. It is preferred, however, to use cellulose ethers such as carboxymethyl cellulose (Na salt), methyl cellulose, hydroxyalkyl cellulose, and mixed ethers such as methylhydroxyethyl cellulose, methylhydroxypropyl cellulose, methylcarboxymethyl cellulose, and mixtures thereof, in quantities from 0.1 to 5 wt % based on the laundry detergents or cleaning agents.

In order effectively to suppress dye dissolution and/or dye transfer onto other textiles during the washing and/or cleaning of colored textiles, the laundry detergent or cleaning agent can contain a color transfer inhibitor. It is preferred that the color transfer inhibitor be a polymer or copolymer of cyclic amines such as, for example, vinylpyrrolidone and/or vinylimidazole. Polymers suitable as color transfer inhibitors encompass polyvinylpyrrolidone (PVP), polyvinylimidazole (PVI), copolymers of vinylpyrrolidone and vinylimidazole (PVP/PVI), polyvinylpyridine-N oxide, poly-N-carboxymethyl-4-vinylpyridium chloride, and mixtures thereof. It is particularly preferred to use polyvinylpyrrolidone (PVP), polyvinylimidazole (PVI), or copolymers of vinylpyrrolidone and vinylimidazole (PVP/PVI) as color transfer inhibitors. The polyvinylpyrrolidones (PVP) that are used preferably possess an average molecular weight from 2,500 to 400,000, and are available commercially from ISP Chemicals as PVP K 15, PVP K 30, PVP K 60, or PVP K 90, or from BASF as Sokalan® HP 50 or Sokalan® HP 53. The copolymers of vinylpyrrolidone and vinylimidazole (PVP/PVI) that are used preferably have a molecular weight in the range from 5000 to 100,000. A PVP/PVI copolymer is available commercially, for example, from BASF under the designation Sokalan® HP 56.

The quantity of color transfer inhibitor, based on the total quantity of the laundry detergent or cleaning agent, is preferably from 0.01 to 2 wt %, by preference from 0.05 to 1 wt %, and more preferably from 0.1 to 0.5 wt %.

Alternatively, however, enzymatic systems encompassing a peroxidase and hydrogen peroxide or a substance yielding hydrogen peroxide in water, can be used as a color transfer inhibitor. The addition of a mediator compound for the peroxidase, for example an acetosyringone, a phenol derivative, or a phenothiazine or phenoxazine, is preferred in this case; the aforementioned polymeric color transfer inhibitors can also be used additionally.

Because textile fabrics, in particular those made of rayon, viscose, cotton, and mixtures thereof, can tend to wrinkle because the individual fibers are sensitive to bending, kinking, pressing, and squeezing perpendicularly to the fiber direction, the agents according to the present invention can contain synthetic wrinkle-protection agents. These include, for example, synthetic products based on fatty acids, fatty acid esters, fatty acid amides, fatty acid alkylol esters, or fatty acid alkylolamides, or fatty alcohols that are usually reacted with ethylene oxide, or products based on lecithin or modified phosphoric acid esters.

In order to counteract microorganisms, the laundry detergents or cleaning agents can contain antimicrobial active substances. A distinction is made here, depending on the antimicrobial spectrum and mechanism of action, between bacteriostatics and bactericides, fungistatics and fungicides, etc. Important substances from these groups are, for example, benzalkonium chlorides, alkylarylsulfonates, halogen phenols, and phenol mercuric acetate; these compounds can also be entirely dispensed with in the laundry detergents or cleaning agents according to the present invention.

The laundry detergents or cleaning agents according to the present invention can contain preservatives, preferably only those that possess little or no skin-sensitizing potential being used. Examples are sorbic acid and its salts, benzoic acid and its salts, salicylic acid and its salts, phenoxyethanol, 3-iodo-2-propynylbutyl carbamate, sodium N-(hydroxymethyl) glycinate, biphenyl-2-ol, and mixtures thereof. A suitable preservative is represented by the solvent-free aqueous combination of diazolidinyl urea, sodium benzoate, and potassium sorbate (available as Euxyl® K 500 from Schuelke & Mayr) which can be used in a pH range of up to 7.

The laundry detergents or cleaning agent can contain antioxidants in order to prevent undesired changes, caused by the action of oxygen and other oxidative processes, to the laundry detergents or cleaning agents and/or to the treated textile fabrics. This class of compounds includes, for example, substituted phenols, hydroquinones, catechols, and aromatic amines, as well as organic sulfides, polysulfides, dithiocarbamates, phosphites, phosphonates, and vitamin E.

Increased wearing comfort can result from the additional use of antistatic agents that are added to the laundry detergents or cleaning agents. Antistatic agents increase the surface conductivity and thus make possible improved dissipation of charges that have formed. External antistatic agents are usually substances having at least one hydrophilic molecule ligand, and yield a more or less hygroscopic film on the surfaces. These usually surface-active antistatic agents can be subdivided into nitrogen-containing (amines, amides, quaternary ammonium compounds), phosphorus-containing (phosphoric acid esters), and sulfur-containing antistatic agents (alkylsulfonates, alkyl sulfates). Lauryl- (or stearyl-) dimethylbenzylammonium chlorides are likewise suitable as antistatic agents for textiles or as an additive to laundry detergents or cleaning agents, an avivage effect additionally being achieved.

In order to improve the rewettability of the treated textile fabrics and to facilitate ironing of the treated textile fabrics, silicone derivatives, for example, can be used in the laundry detergents or cleaning agents. These additionally improve the rinsing behavior of the laundry detergents or cleaning agents thanks to their foam-inhibiting properties. Preferred silicone derivatives are, for example, polydialkyl- or alkylarylsiloxanes in which the alkyl groups have one to five carbon atoms and are entirely or partly fluorinated. Preferred silicones are polydimethylsiloxanes, which optionally can be derivatized and are then aminofunctional or quaternized or have Si—OH, Si—H, and/or Si—Cl bonds. The viscosities of the preferred silicones are in the range between 100 and 100,000 mPas at 25° C.; the silicones can be used in quantities between 0.2 and 5 wt % based on the entire laundry detergent or cleaning agent.

Lastly, the laundry detergents or cleaning agents can also contain UV absorbers, which are absorbed onto the treated textile fabrics and improve the light-fastness of the fibers. Compounds that exhibit these desired properties are, for example, the compounds that act by radiationless deactivation, and derivatives of benzophenone having substituents in the 2- and/or 4-position. Also suitable are substituted benzotriazoles, acrylates phenyl-substituted in the 3-position (cinnamic acid derivatives) optionally having cyano groups in the 2-position, salicylates, organic Ni complexes, and natural substances such as umbelliferone and endogenous urocanic acid.

Substances that complex heavy metals can be used in order to avoid the heavy-metal-catalyzed breakdown of certain washing-agent ingredients, it is possible to use. Suitable heavy metal complexing agents are, for example, the alkali salts of ethylenediaminetetraacetic acid (EDTA) or of nitrilotriacetic acid (NTA), as well as alkali-metal salts of anionic polyelectrolytes such as polymaleates and polysulfonates.

A preferred class of complexing agents is the phosphonates, which are contained in preferred laundry detergents or cleaning agents in quantities from 0.01 to 2.5 wt %, by preference 0.02 to 2 wt %, and in particular from 0.03 to 1.5 wt %. Among these preferred compounds are, in particular, organophosphonates such as, for example, 1-hydroxyethane-1,1-diphosphonic acid (HEDP), aminotri(methylenephosphonic acid) (ATMP), diethylenetriamine penta(methylenephosphonic acid) (DTPMP or DETPMP), and 2-phosphonobutane-1,2,4-tricarboxylic acid (PBS-AM), which are usually used in the form of their ammonium or alkali-metal salts.

Neutral filler salts such as sodium sulfate or sodium carbonate can additionally be contained in the solid laundry detergent or cleaning agent.

The laundry detergents or cleaning agents according to the present invention can be used in particular for the cleaning and conditioning of textile fabrics.

For manufacture of the laundry detergents or cleaning agents according to the present invention, firstly the laundry detergent or cleaning agent without the textile-care compound is manufactured using known methods, which can encompass e.g. drying steps, mixing steps, compaction steps, shaping steps, and/or post-addition of heat-sensitive ingredients. The product thus obtained is then mixed with a solid textile-care composition according to the present invention. For the manufacture of shaped laundry-detergent or cleaning-agent elements, further compaction and/or shaping steps can follow the mixing step.

Textile-care compositions E1 to E5 according to the present invention are shown in Table 1:

| | E1 | E2 | E3 | E4 | E5 |
|---|---|---|---|---|---|
| Palm oil fatty acids | 96.99 | 88.99 | 81.99 | 80.99 | 88.99 |
| Glycerol | — | 7 | 8 | 7 | 7 |
| Sorbitol | — | 1 | 1 | 1 | 1 |
| Bentonite | — | — | 5 | — | — |
| Silica | — | — | 2 | — | — |
| Perfume | 2 | 2 | 2 | 5 | 2 |
| Polydimethylsiloxane | 1 | 1 | — | 6 | — |
| Polyquaternium-7 | — | — | — | — | 1 |
| Dye | 0.01 | 0.01 | 0.01 | 0.01 | 0.01 |

For comparison of the scent intensity of a conventional liquid conditioner (textile-softening diesterquat concentration: 15 wt %) with the solid textile-care compositions E1 to E5, terry cloth fabric was treated in a washing machine (Miele Novotronic W 985) on the one hand with a commercially obtainable solid laundry detergent and the conventional conditioner, and on the other hand with the same laundry detergent and the respective solid textile-care compositions E1 to E5. After line drying, the scent intensity was determined. In all cases (on wet, freshly washed laundry, on dried laundry after one day, and on dried laundry after seven days), the scent intensity in the context of treatment with the textile-care compositions E1 to E5 according to the present invention was stronger than in the context of treatment with the conventional conditioner.

The textile-care compositions according to the present invention furthermore exhibited a softening effect as compared with water (the fabrics treated with water and with textile-care composition had been handled for that purpose, after treatment and line drying, by a panel of five persons). In addition, the textile-care compositions according to the present invention are capable of reducing the hardness of water. For this, firstly the hardness of tap water was determined using Total Hardness test sticks (Merck) in accordance with the manufacturer's instructions. The solid textile-care composition E2 according to the present invention was then added to the tap water at a concentration indicated in the manufacturer's instructions, and the water's hardness was determined. The water hardness had been reduced from 16° dH to 3° dH.

In order to manufacture a laundry detergent or cleaning agent according to the present invention, a solid, unperfumed laundry detergent or cleaning agent was mixed with 10 wt % (based on the total quantity of finished laundry detergent or cleaning agent) of textile-care composition E2.

The laundry detergent or cleaning agent according to the present invention exhibited good cleaning and conditioning properties.

Lime deposits on the laundry and/or deposits or residues in the bleach dispenser of the washing machines were not observed either with separate utilization of the textile-care composition or when introduced into a laundry detergent or cleaning agent.

Other than where otherwise indicated, or where required to distinguish over the prior art, all numbers expressing quantities of ingredients herein are to be understood as modified in all instances by the term "about". As used herein, the words "may" and "may be" are to be interpreted in an open-ended, non-restrictive manner. At minimum, "may" and "may be" are to be interpreted as definitively including, but not limited to, the composition, structure, or act recited.

As used herein, and in particular as used herein to define the elements of the claims that follow, the articles "a" and "an" are synonymous and used interchangeably with "at least one" or "one or more," disclosing or encompassing both the singular and the plural, unless specifically defined herein otherwise. The conjunction "or" is used herein in both in the conjunctive and disjunctive sense, such that phrases or terms conjoined by "or" disclose or encompass each phrase or term alone as well as any combination so conjoined, unless specifically defined herein otherwise.

In order to avoid the heavy-metal-catalyzed breakdown of certain washing-agent ingredients, it is possible to use substances that complex heavy metals. Suitable heavy metal complexing agents are, for example, the alkali salts of ethylenediaminetetraacetic acid (EDTA) or of nitrilotriacetic acid (NTA), as well as alkali-metal salts of anionic polyelectrolytes such as polymaleates and polysulfonates.

Changes in form and substitution of equivalents are contemplated as circumstances may suggest or render expedient. Although specific terms have been employed herein, such terms are intended in a descriptive sense and not for purposes of limitation.

What is claimed:

1. A particle form, solid textile-care composition, comprising a soap matrix, wherein the soap matrix comprises 90 to 98 weight percent of soap, and, distributed within the soap matrix, a textile-care compound and a perfume, wherein the soap matrix further comprises propylene glycol, dipropylene glycol, ethylene glycol, diethylene glycol, 1,3-butylene glycol, 2,3-butylene glycol, sorbitol, glycerol, mannitol, glucose, sucrose, galactose, fructose, lactose, dextrose, or a mixture thereof.

2. The solid textile-care composition of claim 1, wherein the textile-care compound is a textile-softening compound, a bleaching agent, a bleach activator, an enzyme, a silicone oil, and an anti-redeposition agent, an optical brightener, a graying inhibitor, a shrinkage preventer, a wrinkle protection agent, a color transfer inhibitor, an antimicrobial active substance, a germicide, a fungicide, an antioxidant, an antistatic agent, an ironing adjuvant, a proofing agent, an impregnation agent, a swelling agent, an anti-slip agent, a UV absorber, or a mixture of any of the foregoing compounds.

3. The composition of claim 1, wherein the textile-care compound is a textile-softening compound.

4. The composition of claim 3, wherein the textile-softening compound is a polysiloxane, a textile-softening clay, a cationic polymer, or a mixture thereof.

5. The composition of claim 1, wherein the soap comprises a sodium salt of a fatty acid.

6. The composition of claim 5, wherein the fatty acid is a palm oil fatty acid, a palm kernel oil fatty acid, a coconut fatty acid, a peanut fatty acid, a tallow fatty acid, a stearic acid, an oleic acid, a soy fatty acid, an olive oil fatty acid, or a mixture thereof.

7. The composition of claim 1, wherein the soap matrix comprises 90 to 97 weight percent of soap.

8. The composition of claim 1, comprising 0.1 to 20 weight percent of the perfume.

9. The composition of claim 7, comprising 1 to 10 weight percent of the perfume.

10. The composition of claim 8, comprising 2 to 7 weight percent of the perfume.

11. The composition of claim 10, wherein the particles have a size range of 0.6 to 30 millimeters.

12. The composition of claim 11, wherein the particles have a size range of 0.8 to 7 millimeters.

13. The composition of claim 12, wherein the particles have a size range of 1 to 3 millimeters.

14. A method of manufacturing a solid textile-care composition, comprising the steps of mixing a soap, a textile care compound, and a perfume to form a matrix of the soap having the textile care compound and the perfume distributed therein, wherein the soap matrix comprises 90 to 98 weight percent of soap and wherein the soap matrix further comprises propylene glycol, dipropylene glycol, ethylene glycol, diethylene glycol, 1,3-butylene glycol, 2,3-butylene glycol, sorbitol, glycerol, mannitol, glucose, sucrose, galactose, fructose, lactose, dextrose, or a mixture thereof, and extruding the matrix through a rhomboidal orifice plate.

15. A method of conditioning a textile fabric, comprising contacting a textile with a conditioning-effective amount of the solid textile care composition of claim 1.

16. A detergent or cleaning agent for laundry comprising a solid textile care composition of claim 1.

17. A method of cleaning and conditioning textile fabrics, comprising contacting a textile fabric with a cleaning or conditioning-effective amount of the laundry detergent or cleaning agent of claim 16.

* * * * *